US006507964B1

(12) United States Patent
Lewandowski et al.

(10) Patent No.: US 6,507,964 B1
(45) Date of Patent: Jan. 21, 2003

(54) SURGICAL TABLE

(75) Inventors: Jeffrey L. Lewandowski, Delton, MI (US); Martin W. Stryker, Kalamazoo, MI (US); William V. Bleeker, Jr., Plainwell, MI (US); James R. Hanson, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 09/592,040

(22) Filed: Jun. 12, 2000

(51) Int. Cl.[7] ..... A61G 13/00
(52) U.S. Cl. ..... 5/600; 5/611; 5/617
(58) Field of Search ..... 5/600, 611, 617, 5/613, 616; 108/147, 2, 6

(56) References Cited

U.S. PATENT DOCUMENTS

| | | | | |
|---|---|---|---|---|
| 4,195,829 A | * | 4/1980 | Reser | 5/607 |
| 4,254,928 A | * | 3/1981 | Huempfner et al. | 5/611 |
| 5,636,394 A | | 6/1997 | Bartley | |
| 5,774,914 A | * | 7/1998 | Johnson et al. | 5/617 |

* cited by examiner

*Primary Examiner*—Heather Shackelford
*Assistant Examiner*—Fredrick Conley
(74) *Attorney, Agent, or Firm*—Flynn, Thiel, Boutell & Tanis, P.C.

(57) ABSTRACT

A bed having a base, a pedestal mounted on the base and a patient supporting member mounted on the pedestal. The pedestal is generally centrally oriented relative to the base and to the patient supporting member and includes a mechanism for effecting an elevating of the patient supporting member relative to the base. A stabilizing mechanism is provided for enabling the pedestal to accommodate differing elevations between the base and the patient supporting member and yet facilitate a maintaining of longitudinal axis congruency between the relatively movable components of the pedestal so that an orientation of the patient supporting member will remain relatively fixed with respect to the base independent of a height of the patient supporting member relative to the base. In addition, the stabilized patient supporting member of the bed has a fowler section wherein the lower region thereof is supported for movement toward the head end of the patient supporting member as the fowler section is elevated from a horizontally aligned position to other positions oriented at an obtuse angle with respect to the remainder portion of the patient supporting member.

18 Claims, 10 Drawing Sheets

SURGICAL TABLE

FIELD OF THE INVENTION

This invention relates to a bed and, more particularly, to a patient supporting bed having a stabilizing mechanism facilitating stabilized support of the patient supporting member in all elevated positions thereof and a traveling fowler mechanism movable to elevated positions without necessitating patient movement lengthwise of the patient supporting member in order to accommodate the elevated position of the fowler section.

BACKGROUND OF THE INVENTION

Wheel supported beds for use in patient care have become more and more sophisticated and more versatile. Beds used as patient supports are now being used to transport patients from a room in which patient care is provided to other facilities within a health care establishment without necessitating removal of the patient from the bed. As a result, it has been a desire to lighten the weight of the patient supporting bed while, at the same time, maintaining a stabilized patient supporting member relative to the base structure for the bed. In beds wherein the patient supporting member is elevatable by hydraulic jacks, electric jacks or the like, it has heretofore been necessary to provide a plurality of such jacks in order to maintain a stabilized arrangement of the patient supporting member on the base structure. It is a desire of this invention to facilitate the reduction of the number of hydraulic jacks, electric jacks or the like and yet maintain the stability of the patient supporting member relative to the base.

Another situation with respect to patient supporting beds having a fowler section adjacent the head end is that when the fowler section is elevated from a horizontal position to one of many elevated or inclined positions forming an obtuse angle with the remainder portion of the patient support member, the fowler section in a sense effects an urging of the patient supported on the patient supporting member toward the foot end of the patient supporting member as the fowler section is elevated from the horizontal position to the aforesaid inclined position. It is a desire to provide a fowler traveling mechanism which will allow the fowler section to be elevatable without necessitating an altering of the position of the patient supported on the patient supporting member.

Accordingly, it is an object of the invention to provide a bed for supporting a patient thereon wherein the patient supporting surface is elevatable relative to the base therefor.

It is a further object of the invention to provide a bed, as aforesaid, wherein a single hydraulic or electrically operated jack is provided for facilitating an elevating of the patient supporting member relative to the base.

It is a further object of the invention to provide a bed, as aforesaid, wherein a stabilizing mechanism is provided between the base structure and the patient supporting member to maintain the patient supporting member stable in every elevated position thereof relative to the base.

It is a further object of the invention to provide a bed, as aforesaid, wherein the use of the stabilizing mechanism enables the number of hydraulic jacks or electrically operated jacks to be reduced and to have the jack or jacks oriented adjacent the geometric center of the base structure as well as operatingly engaged with the patient supporting member adjacent the geometric center location thereof.

It is a further object of the invention to provide a bed, as aforesaid, wherein the patient support surface stabilizing mechanism is of durable construction and requires little or no maintenance.

It is a further object of the invention to provide a bed having a patient supporting member with an elevatable fowler section having associated therewith a mechanism that prevents the patient from being moved lengthwise of the bed in response to movements of the fowler section from the horizontal position toward an elevated or inclined position relative to the remainder portion of the patient supporting member.

It is a further object of the invention to provide the fowler section with a guide section and structure for facilitating low friction guiding of the fowler section with respect to the guide structure therefor, even when forces tending to twist the fowler section out of a generally flat orientation are applied to the fowler section.

It is a further object of the invention to provide a bed, as aforesaid, wherein the traveling fowler section is of a durable construction requiring little or no maintenance.

SUMMARY OF THE INVENTION

The objects and purposes of the invention are met by providing a bed having a base, a pedestal mounted on the base and a patient supporting member mounted on the pedestal. The pedestal is generally centrally oriented relative to the base and to the patient supporting member and includes a mechanism for effecting an elevating of the patient supporting member relative to the base. A stabilizing mechanism is provided for enabling the pedestal to accommodate differing elevations between the base and the patient supporting member and yet facilitate a maintaining of longitudinal axis congruency between the relatively movable components of the pedestal so that an orientation of the patient supporting member will remain relatively fixed with respect to the base independent of a height of the patient supporting member relative to the base.

In addition, the patient supporting member of the bed has a fowler section wherein the lower region thereof is supported for movement toward the head end of the patient supporting member as the fowler section is elevated from a horizontally aligned position to other positions oriented at an obtuse angle with respect to the remainder portion of the patient supporting member. This movement of the lower region of the fowler section enables the patient to remain situated on the patient supporting member and without necessitating longitudinal movement of the patient relative to the patient supporting member in response to varying angles of inclination of the fowler section with respect to the remainder portion of the patient supporting member.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
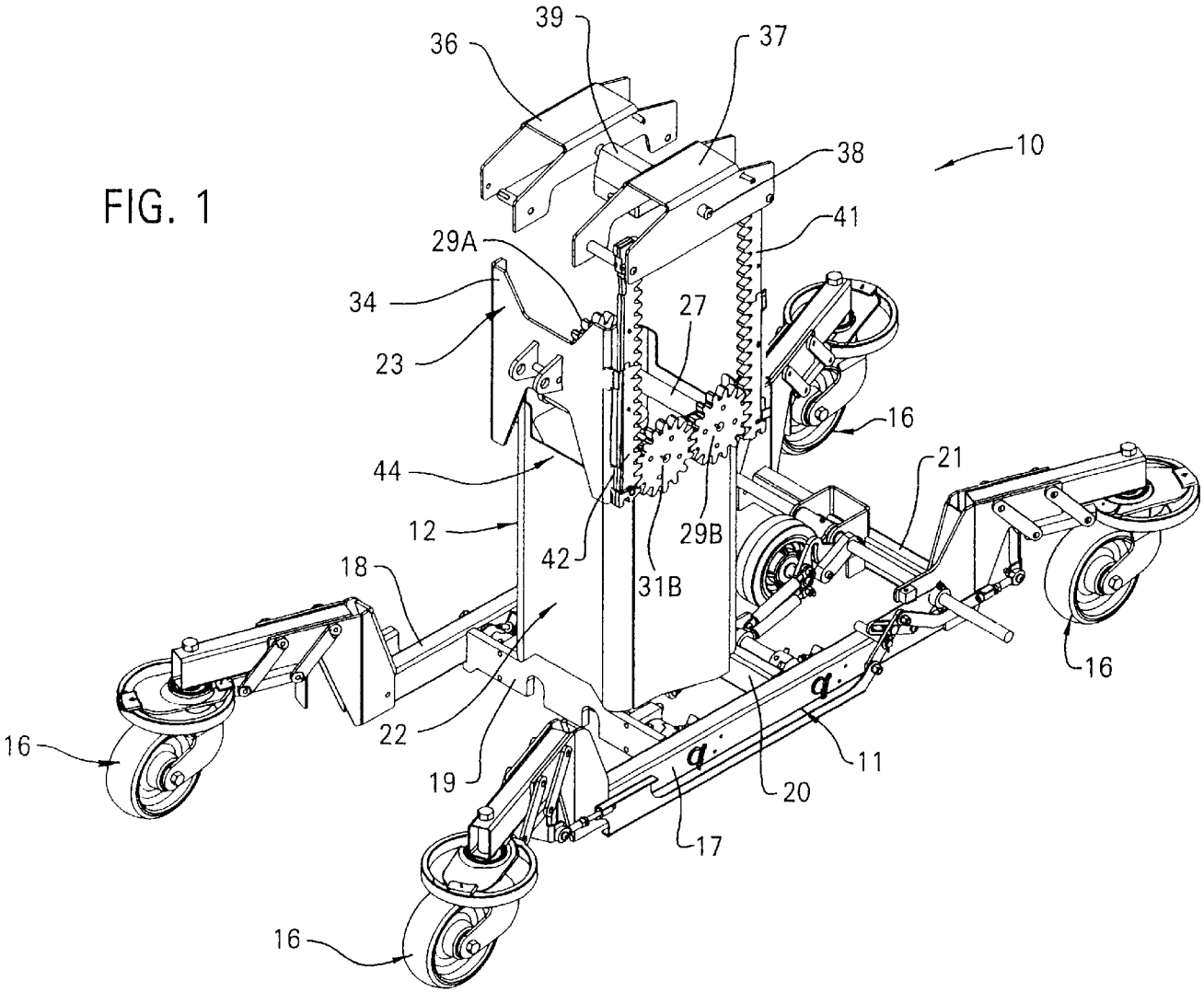
FIG. 1 is a prospective view of a base having a centralized pedestal mechanism mounted thereon.

A patient supporting bed 10 is illustrated in FIG. 1 and includes a wheel supported base 11 on which is supported a pedestal 12 which enshrouds a jack member 13 facilitating elevational movement of a patient supporting member 14 mounted thereon. The wheel supported base 11 includes, in this particular embodiment, four caster-type wheels 16, one in each of the four corners of the patient supporting bed 10.

The base frame 11 includes a pair of elongate side rails 17 and 18 interconnected by cross braces 19, 20 and 21. It is at the longitudinal ends of each of the side rails 17 and 18 that the aforesaid caster-type wheels 16 are located.

Figure 4:
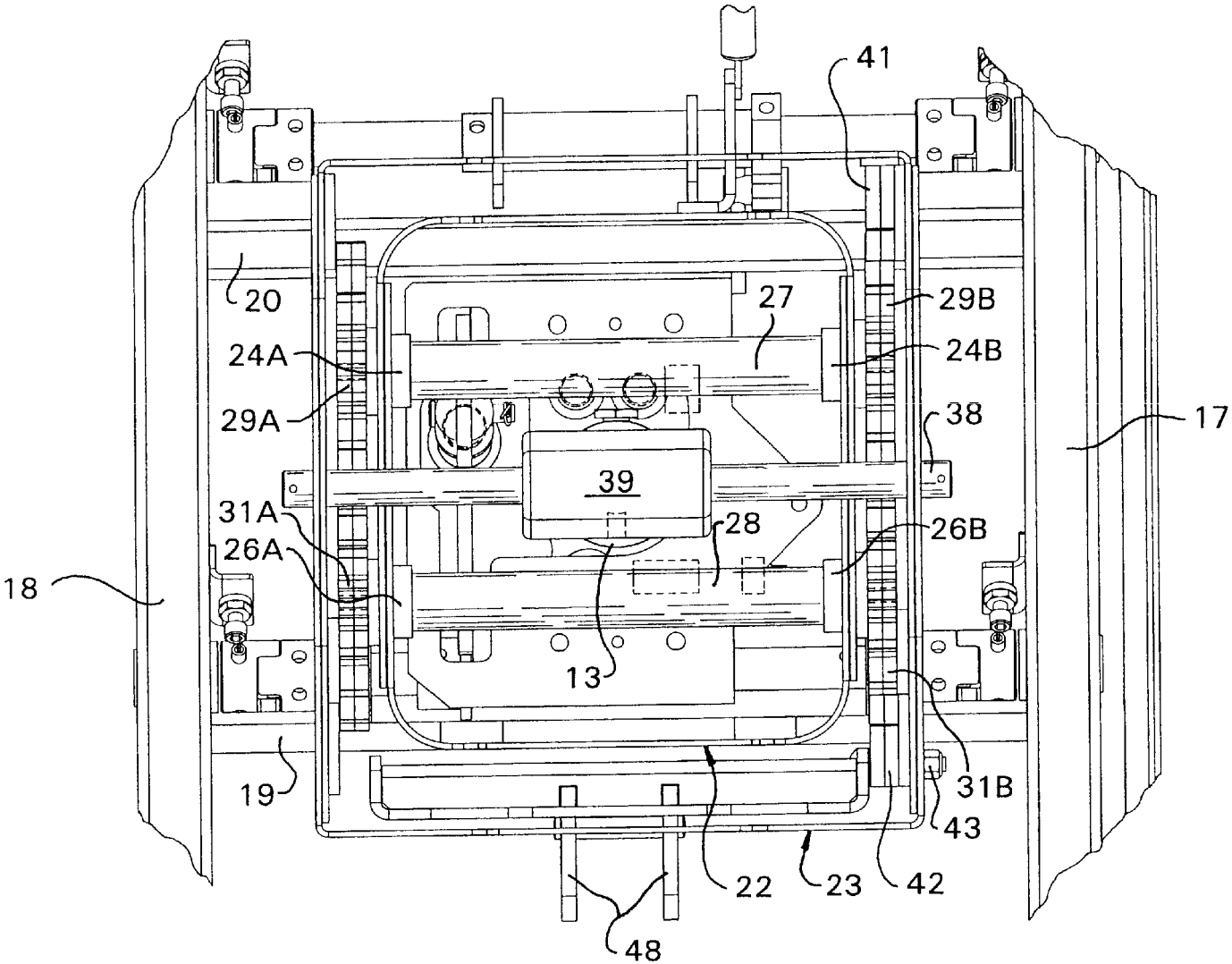
FIG. 4 is a top view of the pedestal construction illustrated in FIG. 1.

The pedestal 12 is composed of two telescopically related pedestal parts 22 and 23. The pedestal part 22 is mounted on the cross braces 19 and 20 and is oriented generally adjacent the geometric center of the base 11. The pedestal part 22 is a four sided hollow shell that extends upwardly from the base 11 and terminates in an upper edge adjacent which is provided two sets of coaxially aligned shaft bearings, namely, shaft bearings 24A and 24B and shaft bearings 26A and 26B. A shaft 27 is rotatably supported by the shaft bearings 24A, 24B. A shaft 28 is rotatably supported by the shaft bearings 26A, 26B. The shaft ends project through the side walls of the pedestal part 22 and have mounted thereat gears. More specifically, the shaft 27 has at opposite ends thereof gears 29A, 29B fixedly secured thereto and rotatable therewith. The shaft 28 has at opposite ends thereof gears 31A and 31B fixedly secured thereto and rotatable therewith. As is clearly depicted in FIGS. 1 and 4, the gears 29B and 31B are meshingly engaged with one another as are the gears 29A and 31A on the opposite ends of the respective shafts 27 and 28.

Figure 2:
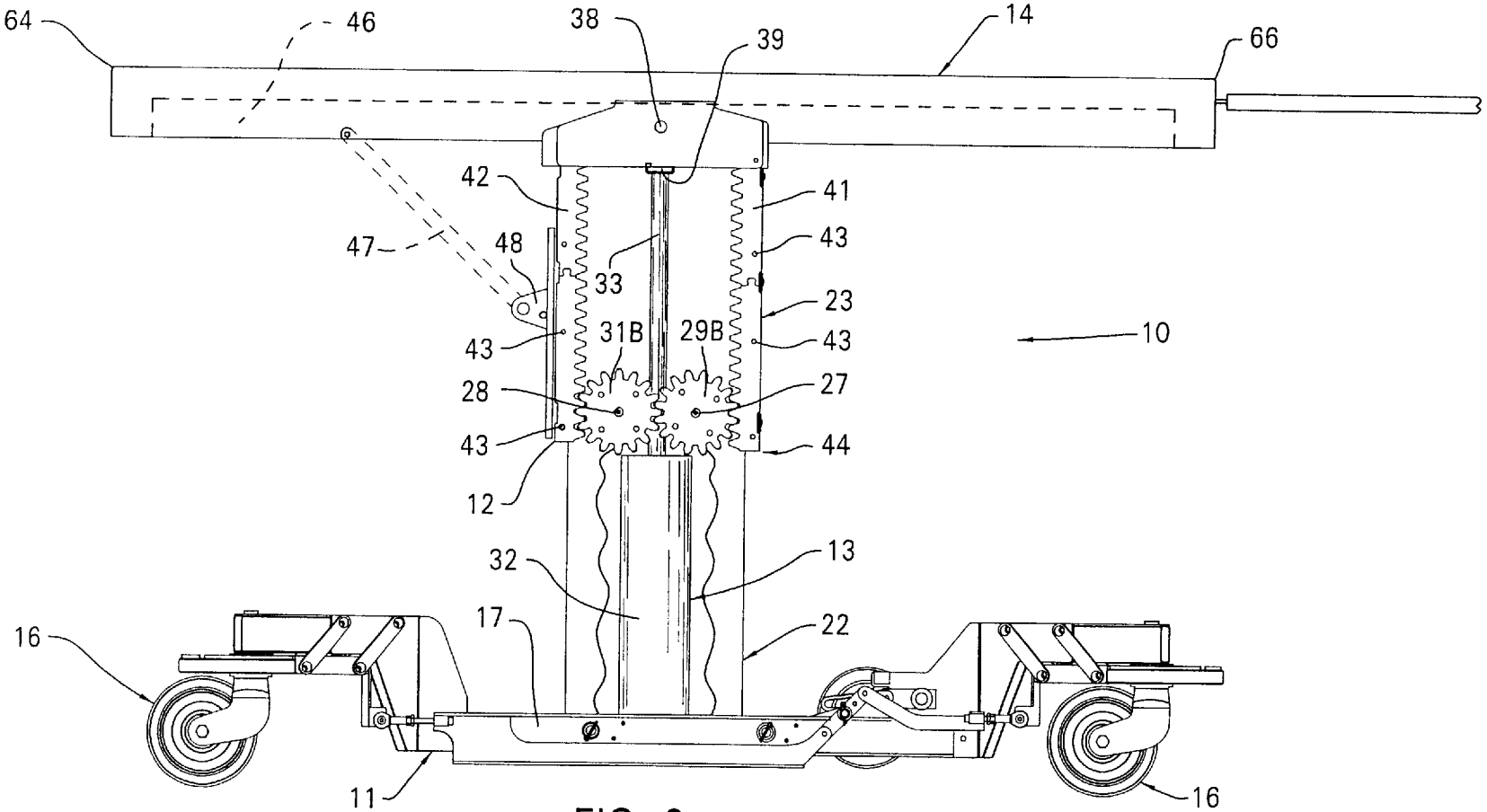
FIG. 2 is a side elevational view of a bed embodying the invention, a cover to one section of the pedestal having been removed in order to reveal the stabilizing mechanism.

Housed within the shell of the pedestal part 22 is the jack 13 as is illustrated in FIG. 2. In this particular embodiment, the jack 13 can be of the hydraulic variety or the electrically operated variety or any equivalent thereto. The jack 13 includes an upstanding cylinder body 32 mounted to the base 11 and includes the requisite mechanisms for facilitating longitudinal reciprocal movement of a rod 33 thereof.

Figure 3:
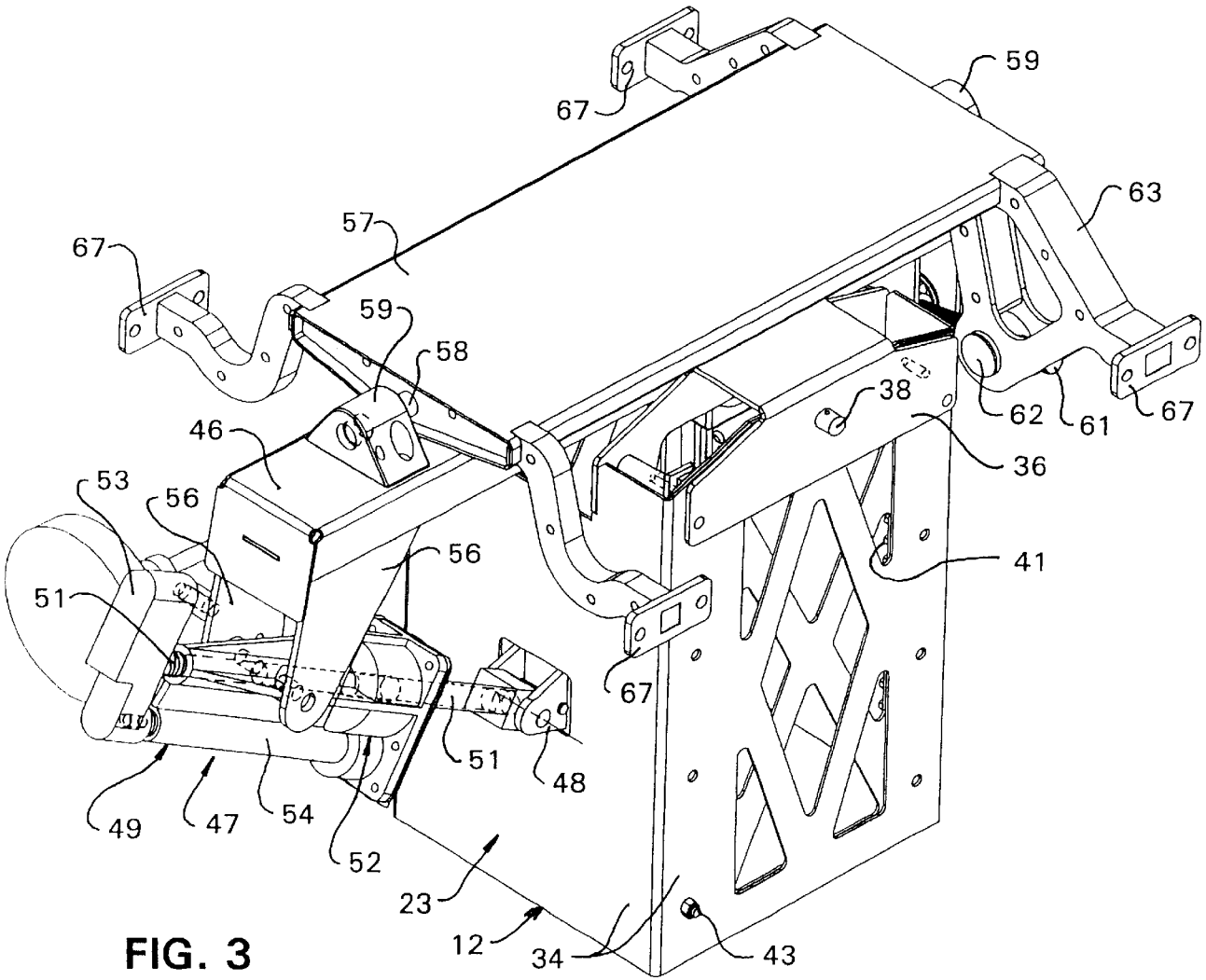
FIG. 3 is an enlarged prospective view of a portion of the pedestal embodying the invention.

The pedestal part 23 is also a hollow shell designed to loosely telescope over the outside of the pedestal part 22. The pedestal part 23 is shown in clearer detail in FIG. 3 and includes a plurality of interconnected vertically upstanding walls 34 terminating at an upper edge thereof in a pair of laterally spaced brackets 36 and 37 each fixedly secured to the walls 34 adjacent the upper edges thereof. The brackets 36 and 37 support an axle 38 which is generally horizontally aligned and oriented generally perpendicular to a vertically upright plane containing the central longitudinal axis of the base 11. A bearing 39 is rotatably supported on the axle 38 intermediate the brackets 36 and 37 as illustrated in FIG. 1. The upper end of the rod 33 of the jack 13 is secured to the bearing 39 as illustrated in FIG. 2.

Mounted to an inside wall surface of the walls 34 of the pedestal part 23 are a pair of elongate toothed racks 41 and 42. In this particular embodiment, the teeth on each of the toothed racks 41 and 42 face one another and the teeth on the rack 41 meshingly engage the teeth on the gear 29B whereas the teeth on the rack 42 meshingly engage the teeth on the gear 31B. A plurality of fasteners 43 effect a securement of each of the toothed racks 41 and 42 to one of the walls 34 of the pedestal part 23. The combination of structure comprising the meshing gears 29A, 31A and 29B, 31B coupled with the meshing relation between the teeth on the gear 29B and the teeth on the toothed rack 41 as well as the teeth on the gear 31B and the teeth on the rack 42 constitute a stabilizing mechanism 44 for rendering stable the pedestal part 23 relative to the pedestal part 22 in all elevated positions of the pedestal part 23 caused by extension and retraction of the rod 33 of the jack 13.

An elongate frame part 46 is fixedly secured to the bearing 39 so that the frame 46 will be supported for tilting motion about the axis of the axle 38. Referring to FIG. 2, the frame 46 will be capable of clockwise and counterclockwise tilting movement about the axle 38. A control linkage 47 is provided between the underside of the frame 46 and a bracket 48 provided on an exterior surface of the wall 34 of the pedestal part 23. In this particular embodiment, and referring to FIG. 3, the length of the control linkage 47 is adjustable by a motorized length adjusting mechanism 49 consisting of an externally threaded and rotatably supported rod 51 pivotally secured and rotatably supported at one end thereof to the bracket 48 and extending outwardly from the wall surface 34. A nut mechanism 52 is provided on a frame 54 pivotally secured between a pair of flanges 56 secured to the underside of the frame 46. A motor 53 is provided on the frame 54 for incrementally rotating the externally threaded rod or screw to cause the frame 46 to pivot about the axle 38.

If desired, a further frame 57 can be mounted on top of the aforementioned frame 46 and supported for pivotal movement about the axis of an axle 58 rotatably supported in bearing housings 59 mounted on the upper facing surface of the frame 46. A motor driven rotatable screw 61 is secured to the underside of the frame 46 and is received in a nut member 62 rotatably supported on a frame part 63 secured to the frame 57 to facilitate adjustment of the rotative position of the frame 57 relative to the frame 46 about the axis of the axle 58.

The patient supporting member 14 is mounted on the combination of the frame 46 and the frame 57 so that it will be supported for a tilting motion about the axle 38 as well as a tilting motion about the axle 58. Pivotal support about the axle 38 will allow the patient supporting member 14 to move to the trendelberg position wherein the head end 64 of the patient supporting member 14 is lower than the foot end 66 as well as to the reverse trendelberg position wherein the head end 64 of the patient supporting member 14 is higher than the foot end 66 thereof.

Figure 5:
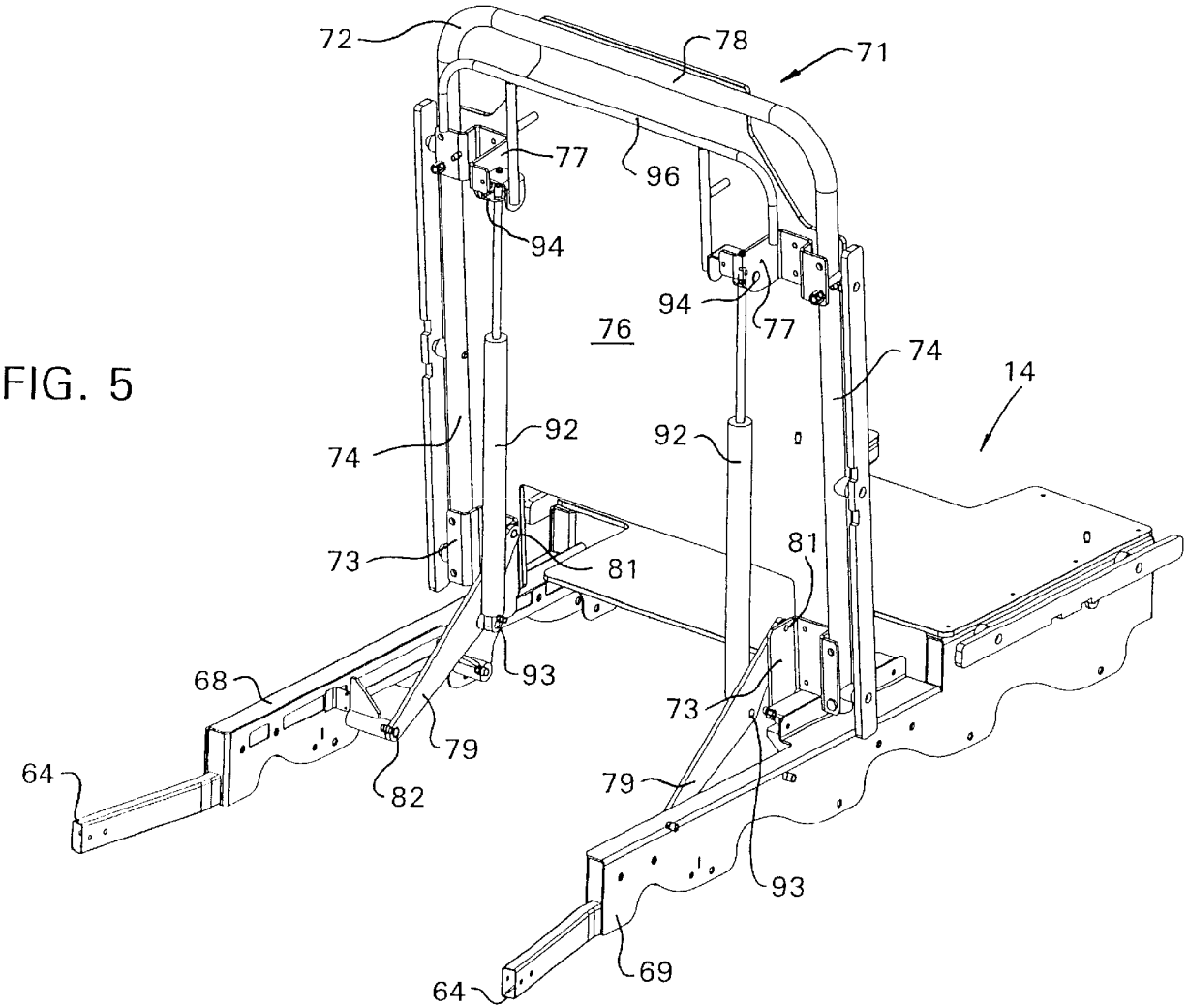
FIG. 5 is a perspective view from the head end of the patient supporting member illustrating the fowler section thereof in an inclined position relative to the remainder portion of the patient supporting member.
Figure 6:
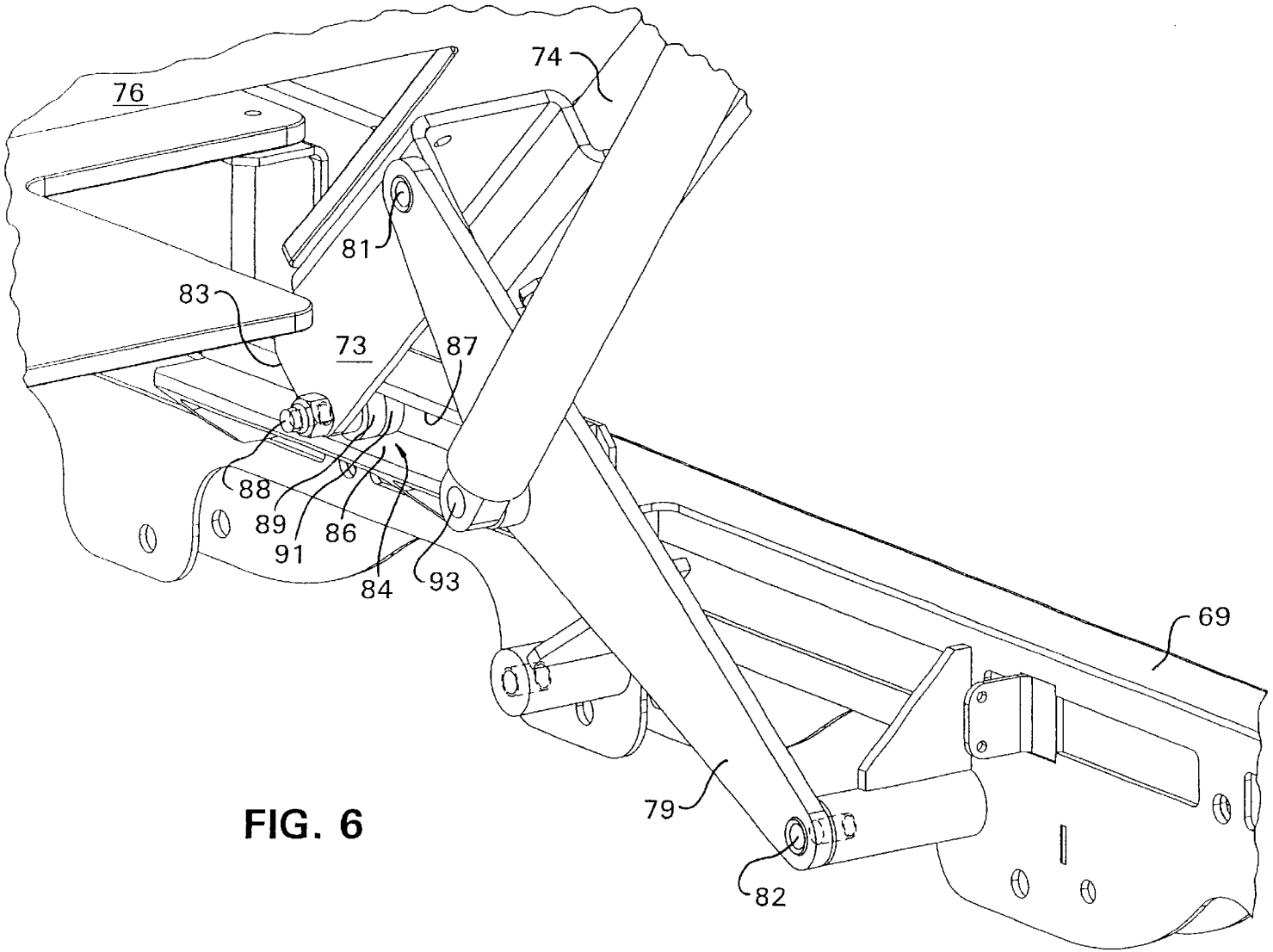
FIG. 6 is an enlarged fragmentary view of the lower region of the fowler section.
Figure 7:
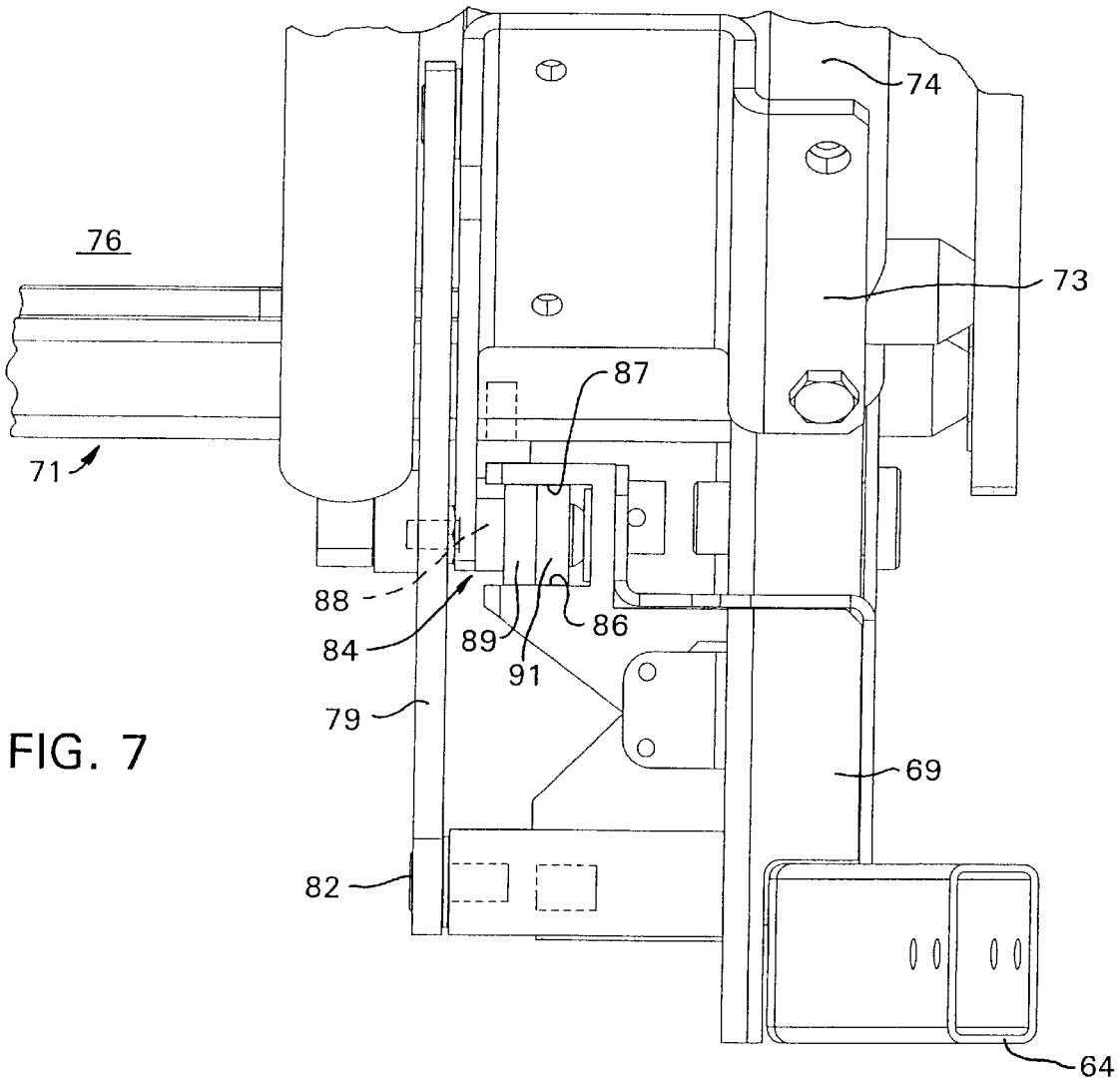
FIG. 7 is an end view of one side of the lower region of the fowler section.

The frame 57 includes a plurality of brackets 67 oriented outwardly therefrom and are adapted to be secured to parallel side rails 68 and 69 (FIG. 5) of the patient supporting member 14. The actual surface, usually a mattress surface, on which the patient is supported extends between the aforesaid side rails 68 and 69. Adjacent the head end 64 of the patient supporting member 14 is a fowler section 71 supported for movement relative to the side rails 68 and 69 by the following described structure. The fowler section 71 includes a generally inverted U-shaped frame 72 having a bracket 73 attached to the free ends of the legs 74 of the U-shaped frame 72. A patient or mattress supporting plate 76 is mounted on the U-shaped frame 72. An additional bracket 77 is mounted to each of the legs 74 of the U-shaped frame 72 adjacent the bight section 78 thereof. A linkage member 79 is pivotally connected to each bracket 73 as at 81 and to each side rail 68 and 69 as at 82. The location of the pivots 81 is oriented above the lowermost end of each of the legs 74 of the U-shaped frame 72 so that as the fowler section 71 rotates relative to each of the links 79 about the pivots 81, the lowermost end of the legs 74 and, consequently, the lowermost edge 83 of each bracket 73 will be caused to move in a direction parallel to the longitudinal axis of the patient supporting member 14. To facilitate this movement, a pair of C-shaped channels 84 are provided wherein the open part of the C-shape of each channel faces each other and the longitudinal center of the patient supporting member 14. Each C-shaped channel has a pair of vertically spaced parallel surfaces 86 and 87 (FIG. 7). An axle 88 is mounted to each of the brackets 73 and extends into the space between the vertically spaced surfaces 86 and 87 of the C-shaped channels 84. A pair of independently rotatable wheels 89 and 91 are rotatably mounted on the axle 88. As is illustrated in FIGS. 6 and 7, the aforementioned independently rotatable wheels 89 and 91 are mounted side by side on the axle 88. The diameter of each of the wheels is identical to each other and is preferably less than the vertical spacing between the surfaces 86 and 87. The side by side orientation of the wheels 89 and 91 oriented between the surfaces 86 and 87 allow for a guided movement of the lowermost region of the frame 72 of the fowler section 71 and in a way that will not encounter obstruction during the aforesaid movement of the lower region of the fowler section in directions toward the head end and the foot end of the patient supporting member 14. If a twisting force is applied to the frame 72 of the fowler section 71, it is likely that one wheel 89 or 91 will engage one surface 86 or 87 while the other wheel engages the other surface. Since the wheels are independently rotatable, and capable of engaging only one surface 86 or 87 at a time, the wheels will provide the requisite guiding motion of the lowermost region of the fowler section relative to each of the side rails 68 and 69.

Figure 8:
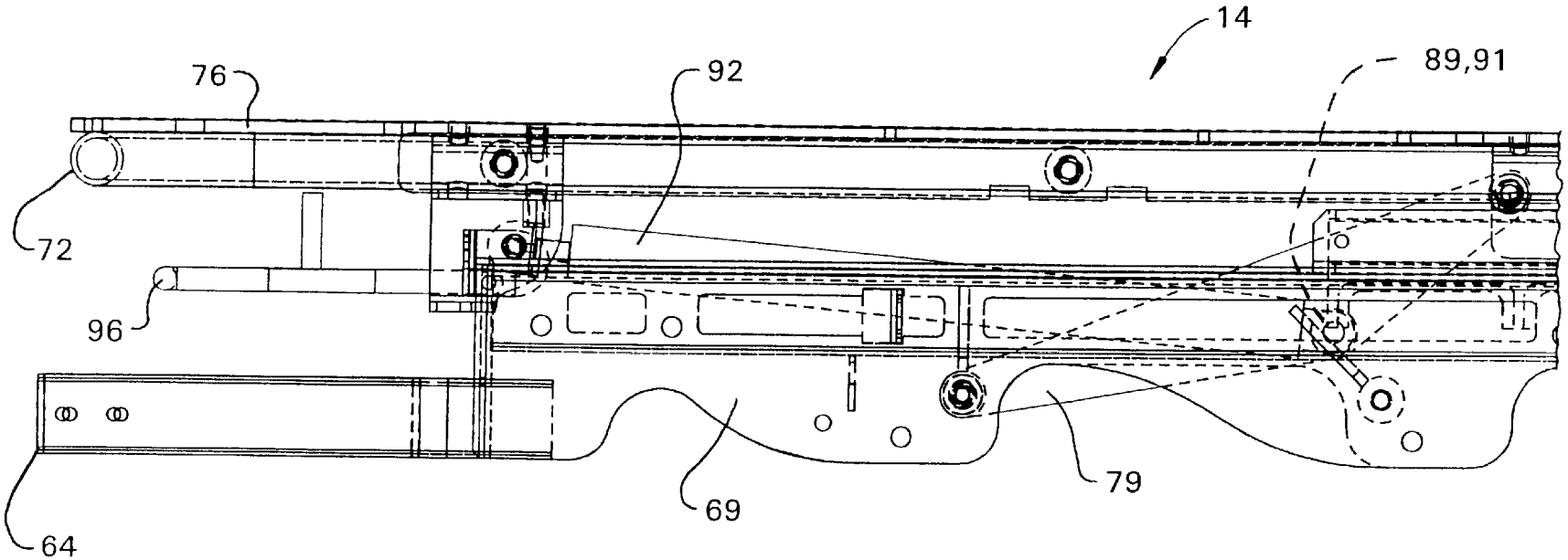
FIG. 8 is a side view of the fowler section in the horizontally aligned position.
Figure 9:
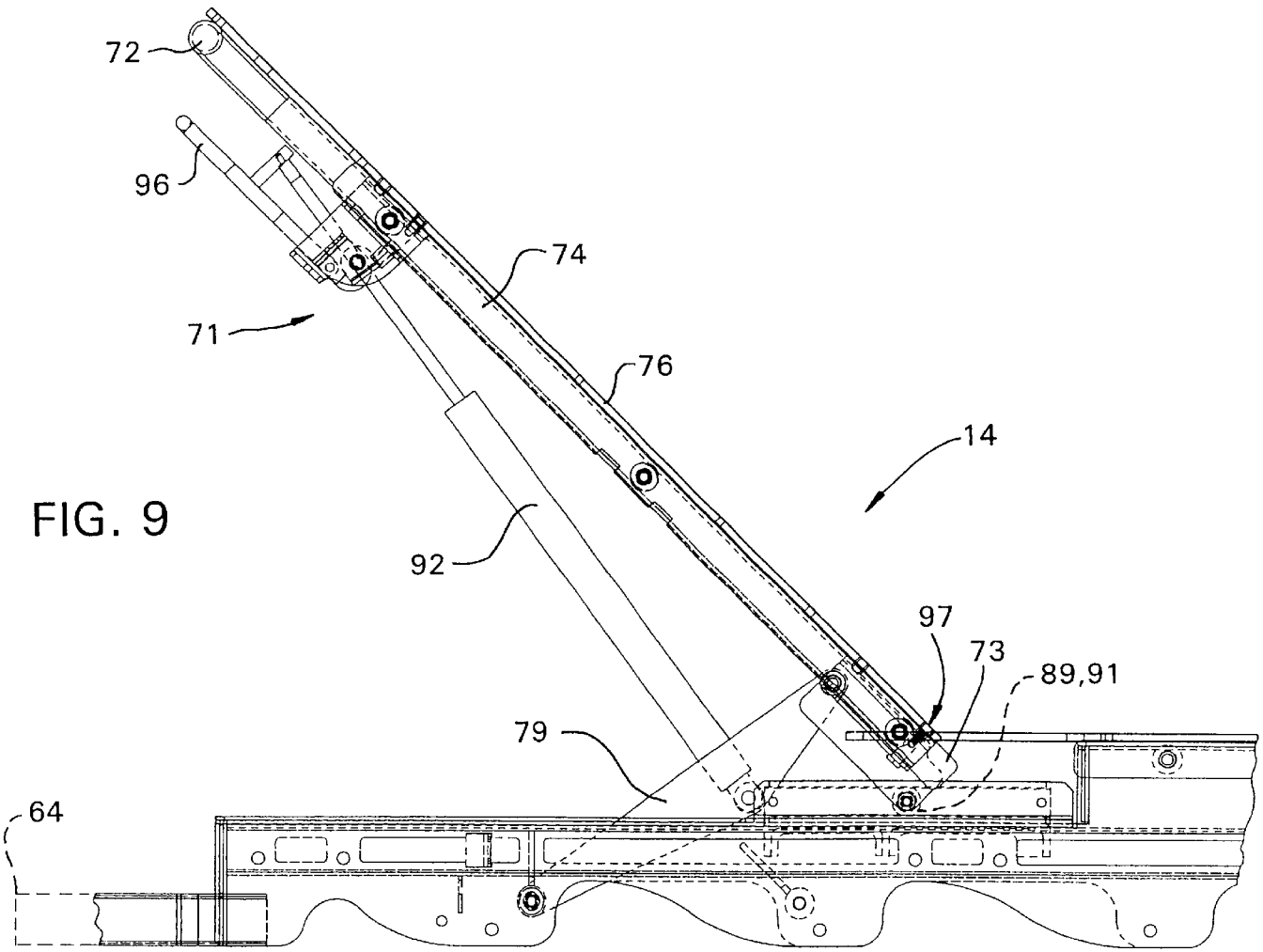
FIG. 9 is a side view of the fowler section in a first elevated position thereof.
Figure 10:
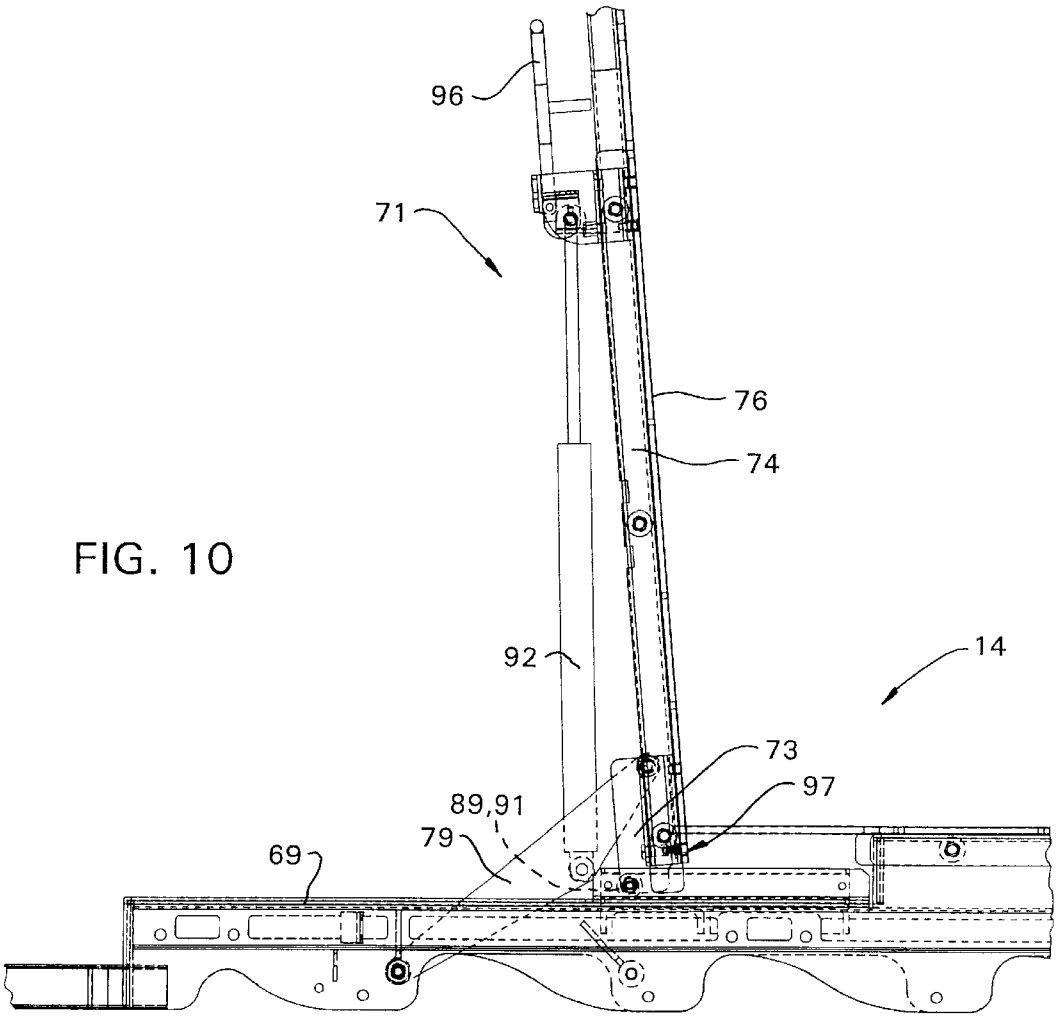
FIG. 10 is a side elevational view of the fowler section in a further elevated position thereof.

The fowler section 71 is drivable by a pair of spring locking gas springs 92 pivotally secured at one end as at 93 to the mid region of the length of the link 79 and at the other end to the bracket 77 as at 94. A manually engagable handle 96 is also pivotally secured to each of the brackets 77 and extends therebetween and includes a mechanism for effecting actuation of the spring locking gas springs 92. The spring locking gas springs 92 and the handle activating mechanism are conventional and are available through Stabilus GmBh in Gastonia, N.C. under the trademark BLOC-O-LIFT. Manipulation of the handle 96 will enable adjustable movement of the fowler section 71 to and between the positions illustrated in FIGS. 8, 9 and 10.

Operation

Although the operation of the mechanisms described above will be understood from the foregoing description by skilled persons, a summary of such description is now given for convenience.

The stabilizing mechanism 44 serves to maintain the pedestal part 23 stabilized with respect to the pedestal part 22. If a downward force is applied to the foot end 66, for example, of the patient supporting member 14 (see FIG. 2), a downward force would be applied to the tooth rack 41 which would tend to drive the toothed gear 29B clockwise about the axis of the axle 27. This clockwise movement of the gear 29B would generate a counterclockwise movement of the gear 31B so that the teeth thereof would urge the toothed rack 42 downwardly. Similarly, a downward force applied to the head end 64 of the patient supporting member would cause a corresponding urging of the geared components but in the opposite direction. Similarly, and since toothed gears 29A, 29B and 31A, 31B are provided on opposite ends of the shafts 27 and 28, downward forces applied to the lateral edges of the patient supporting member 14 will cause similar actions described above of the aforesaid gears of the stabilizing mechanism 44 to maintain the pedestal part 23 stabilized with respect to the pedestal part 22. It is to be noted that the pedestal part 23 is supported solely on the intermeshed gears 29A, 29B and 31A, 31B through the interconnection of the aforesaid gears to the toothed racks 41 and 42.

As the rod 33 of the jack 13 is reciprocated, the intermeshed gears 29A, 29B and 31A, 31B will rotate in opposite directions while the teeth thereof walk along the teeth of the racks 41 and 42 to effect a stabilized raising and lowering of the patient supporting member without losing the stabilized relationship between the pedestal parts 22 and 23.

The stabilizing mechanism 44 translates also into a stabilized positioning of the patient supporting member and the fowler section mounted thereon. In this particular embodiment, and since the lower end of the fowler section 71 traverses lengthwise of the patient supporting member 14 by reason of the side by side rollers 89, 91 moving lengthwise in the C-shaped channels 84, it will be unnecessary for a patient supported on the patient supporting member 14 to move longitudinally of the patient supporting member in response to movements of the fowler section 71 between the positions illustrated in FIGS. 8-10. That is, as the fowler section 71 is moved from the FIG. 8 position toward the FIG. 9 position and toward the FIG. 10 position, the lowermost position 97 is moved toward the head end 64 of the patient supporting member so that the lower back region of the patient will be better accommodated as the patient is moved toward the upright sitting position. As a result, it is unnecessary for the patient to reorient himself/herself lengthwise of the patient supporting member 14 as the fowler section 71 is moved toward the elevated position illustrated in FIGS. 9 and 10. This is due to the fact that the lowermost region 97 of the fowler section withdraws from the back of the patient supported on the patient supporting member to accommodate a change in body position from one that is lying flat in a horizontal position to one that is in the upright sitting position.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In a bed, comprising:

a base;

a pedestal mechanism mounted on said base, a patient supporting member mounted on said pedestal, said patient supporting member having a head end and a foot end, the improvement wherein;

said pedestal mechanism includes a single pedestal centrally disposed on said base and comprising a first elongate part mounted to said base and a second elongate part mounted to said patient supporting member, said first and second elongate parts being supported by stabilizing means for longitudinal movement with respect to one another to facilitate elevational adjustment of said patient supporting member, said stabilizing means maintaining longitudinal axis congruency of said first and second elongate parts independent of relative location of said first and second elongate parts so that an orientation of said patient supporting member will remain relatively fixed with respect to said base independent of a height thereof relative to said base; and wherein said patient supporting member is pivotally secured to said second elongate part for movement about a pivot axis, and wherein a lengthwise adjustment brace is secured to and extends between said patient supporting member adjacent at least one of said head end and said foot end and a side of said second elongate part-facing said at least one of said head end and said foot end and wherein said lengthwise adjusting brace extends in a plane parallel to a longitudinal axis of said patient supporting member, said pivot axis being oriented perpendicular to said plane.

2. The bed according to claim 1, wherein said patient supporting member includes a fowler section adjacent said head end and being supported for movement between a first horizontally aligned position and a second position oriented at an obtuse angle to the horizontal.

3. The bed according to claim 2, wherein said patient supporting member includes a frame and wherein said fowler section is supported on said frame for movement between a first horizontally aligned position and a second position oriented at an obtuse angle to the horizontal.

4. The bed according to claim 3, wherein said frame includes linkage means interconnecting said fowler section and said frame for causing a lowest region of said fowler section to move toward and away from said head end of said frame in response to movements of said fowler section between said first and second positions, said linkage means including at least one side opening C-shaped elongate guide on said frame and extending parallel to a longitudinal axis of said elongate frame, said C-shape elongate guide including first and second spaced and parallel guide surfaces, said lowest region having at least one pair of independently rotatable rollers disposed between said first and second spaced surfaces and for rotation about parallel axes of rotation extending parallel to said first and second spaced surfaces and perpendicular to said longitudinal axis of said elongate frame.

5. In a bed, comprising:

a base;

a pedestal mounted on said base, a patient supporting member mounted on said pedestal, said patient supporting member having a head end and a foot end, the improvement wherein;

said pedestal includes a first elongate part mounted to said base and a second elongate part mounted to said patient supporting member, said first and second elongate parts being supported by stabilizing means for longitudinal movement with respect to one another to facilitate elevational adjustment of said patient supporting member, said stabilizing means maintaining longitudinal axis congruency of said first and second elongate parts independent of relative location of said first and second elongate parts so that an orientation of said patient supporting member will remain relatively fixed will respect to said base independent of a height thereof relative to said base, said stabilizing means including a first pair of axially spaced gears fixedly mounted to a first shaft and a second pair of axially spaced gears fixedly mounted to a second shaft, said first and second shafts being rotatingly supported on one of said first and second elongate parts so that each gear of said first pair meshingly engages a respective gear of said second pair, and first and second pairs of gear racks mounted on the other of said first and second elongate parts so that teeth on each said first pair of racks meshingly engage a respective one of said gears of said first pair of gears on said first shaft and on a side thereof diametrically remote from said gears of said second pair of gears and teeth on each said second pair of racks meshingly engage a respective one of said gears of said second pair of gears on said second shaft and on a side thereof diametrically remote from said gears of said first pair of gears; and wherein said patient supporting member is pivotally secured to said second elongate part for movement about a pivot axis, and wherein a lengthwise adjustable brace is secured to and extends between said patient supporting member adjacent at least one of said head end and said foot end and a side of said second elongate part facing said at least one of said head end and said foot end and wherein said lengthwise adjusting brace extends in a plane parallel to a longitudinal axis of said patient supporting member, said pivot axis being oriented perpendicular to said plane.

6. The bed according to claim 5, wherein said stabilizing means provides the sole support of said second elongate part on said first elongate part.

7. The bed according to claim 5, wherein said patient supporting member includes a fowler section adjacent said head end and being supported for movement between a first horizontally aligned position and a second position oriented at an obtuse angle to the horizontal.

8. The bed according to claim 5, wherein said patient supporting member includes a frame and wherein said fowler section is supported on said frame for movement between a first horizontally aligned position and a second position oriented at an obtuse angle to the horizontal.

9. The bed according to claim 8, wherein said frame includes linkage means interconnecting said fowler section and said frame for causing a lowest region of said fowler section to move toward and away from said head end of said frame in response to movements of said fowler section between said first and second positions, said linkage means including at least one side opening C-shaped elongate guide on said frame and extending parallel to a longitudinal axis of said elongate frame, said C-shape elongate guide including first and second spaced and parallel guide surfaces, said lowest region having at least one pair of independently rotatable rollers disposed between said first and second spaced surfaces and for rotation about parallel axes of rotation extending parallel to said first and second spaced surfaces and perpendicular to said longitudinal axis of said elongate frame.

10. In an articulated bed, comprising:

an elongate frame having a head end and a foot end;

at least a fowler section adjacent said head end of said frame and being supported on said frame for movement between a first horizontal aligned position and a second position oriented at an obtuse angle to the horizontal;

linkage means interconnecting said fowler section and said frame for causing a lowest region of said fowler section to move toward and away from said head end of said frame in response to movements of said fowler section between said first and second positions, said linkage means including at least one side opening, C-shaped elongate guide on said frame and extending parallel to a longitudinal axis of said elongate frame, said C-shape elongate guide including first and second spaced and parallel guide surfaces, said lowest region having at least one pair of independently rotatable rollers disposed between said first and second spaced surfaces and for rotation about parallel axes of rotation extending parallel to said first and second spaced surfaces and perpendicular to said longitudinal axis of said elongate frame.

11. The articulated bed according to claim 10, wherein said frame includes a patient supporting surface of which said fowler section is a part, said linkage means including a first link member pivotally secured to and extending between said frame and a location on said fowler section intermediate said lowest region and said pair of rollers thereat and a head end remote therefrom, and an extendable and retractive motive means secured to and extending between said first link and fowler section at a location adjacent said head end thereof.

12. The articulated bed according to claim 10, wherein said extendable and retractive motive means includes a manual control adjacent said head end of said fowler section for latching and unlatching said motive means to facilitate an extension or retraction thereof and a movement of said fowler section between said first and second positions thereof.

13. In a bed, comprising:

a base;

a pedestal mounted on said base;

a patient supporting member mounted on said pedestal, said patient supporting member having a head end and a foot end, the improvement wherein;

said pedestal includes a first elongate part upstandingly mounted to said base and a second elongate part mounted to said patient supporting member and including a hollow shell configured to telescope over an outside surface of said first elongate part, said first and second elongate parts being supported by stabilizing means for longitudinal movement with respect to one another to facilitate elevational adjustment of said patient supporting member, said stabilizing means maintaining longitudinal axis congruency of said first and second elongate parts independent of relative location of said first and second elongate parts so that an orientation of said patient supporting member will remain relatively fixed with respect to said base independent of a height thereof relative to said base, said stabilizing means including a first pair of axially spaced gears fixedly mounted to a first shaft and a second pair of axially spaced gears fixedly mounted to a second shaft, said first and second shafts being rotatingly supported on said first elongate part so that each gear of said first pair meshingly engages a respective gear of said second pair, and first and second pairs of gear racks mounted on an inside facing surface of said hollow shell of said second elongate part so that teeth on each said first pair of racks meshingly engage a respective one of said gears of said first pair of gears on said first shaft and on a side thereof diametrically remote from said gears of said second pair of gears and teeth on each said second pair of racks meshingly engage a respective one of said gears of said second pair of gears on said second shaft and on a side thereof diametrically remote from said gears of said first pair of gears; and wherein said patient supporting member is pivotally secured to said second elongate part for movement about a pivot axis, and wherein a lengthwise adjustable brace is secured to and extends between said patient supporting member adjacent at least one of said head end and said foot end and a side of said second elongate part facing said at least one of said head end and said foot end and wherein said lengthwise adjusting brace extends in a plane parallel to a longitudinal axis of said patient supporting member, said pivot axis being oriented perpendicular to said plane.

14. The bed according to claim 13, wherein said stabilizing means provides the sole support of said second elongate part on said first elongate part.

15. The bed according to claim 13, wherein said patient supporting member includes a fowler section adjacent said head and being supported for movement between a first horizontally aligned position and a second position oriented at an obtuse angle to the horizontal.

16. The bed according to claim 15, wherein said patient supporting member includes a frame and wherein said fowler section is supported on said frame for movement between a first horizontally aligned position and a second position oriented at an obtuse angle to the horizontal.

17. The bed according to claim 16, wherein said frame includes linkage means interconnecting said fowler section and said frame for causing a lowest region of said fowler section to move toward and away from said head end of said frame in response to movements of said fowler section between said first and second positions, said linkage means including at least one side opening C-shaped elongate guide on said frame and extending parallel to a longitudinal axis of said elongate frame, said C-shape elongate guide including first and second spaced and parallel guide surfaces, said lowest region having at least one pair of independently rotatable rollers disposed between said first and second spaced surfaces and for rotation about parallel axes of rotation extending parallel to said first and second spaced surfaces and perpendicular to said longitudinal axis of said elongate frame.

18. The bed according to claim 13, wherein said first elongate part includes a second hollow shell; wherein a jack is provided and includes a cylinder housing upstandingly mounted on said base inside said second hollow shell and having a rod reciprocal relative to said cylinder housing, a distal end thereof being connected to the first mentioned hollow shell.

* * * * *